US006394366B1

(12) United States Patent
Adams

(10) Patent No.: US 6,394,366 B1
(45) Date of Patent: May 28, 2002

(54) SPRAY NOZZLE ASSEMBLY

(75) Inventor: Robert J. Adams, St. Charles, IL (US)

(73) Assignee: Spraying Systems Co., Wheaton, IL (US)

( * ) Notice: Subject to any disclaimer, the term of this patent is extended or adjusted under 35 U.S.C. 154(b) by 32 days.

(21) Appl. No.: 09/698,628

(22) Filed: Oct. 27, 2000

(51) Int. Cl.[7] ..... B05B 1/34
(52) U.S. Cl. ..... 239/463; 239/488
(58) Field of Search ..... 239/461, 462, 239/463, 487, 488, 589, 590; 169/65

(56) References Cited

U.S. PATENT DOCUMENTS

| | | | | |
|---|---|---|---|---|
| 2,574,865 A | * | 11/1951 | Edwards | 239/462 |
| 2,999,648 A | * | 9/1961 | Wahlin et al. | 239/463 |
| 3,275,248 A | * | 9/1966 | O'Brien et al. | 239/466 |
| 3,692,245 A | * | 9/1972 | Needham et al. | 239/488 |
| 4,474,331 A | * | 10/1984 | Aprea et al. | 239/488 |
| 4,613,079 A | * | 9/1986 | Mains | 239/462 |
| 4,624,414 A | | 11/1986 | Ferrazza | |
| 4,664,314 A | | 5/1987 | O'Brien et al. | |
| 5,143,298 A | | 9/1992 | Prokopoff | |
| 5,868,321 A | | 2/1999 | Haruch | |
| 6,076,744 A | | 6/2000 | O'Brien | |

* cited by examiner

*Primary Examiner*—Lesley D. Morris
(74) *Attorney, Agent, or Firm*—Leydig, Voit & Mayer, Ltd.

(57) ABSTRACT

A spray nozzle of a fire protection system is provided for discharging a hollow cone spray pattern. The nozzle generally includes a hollow, elongated body and an integral core subassembly which may be preassembled. The integral subassembly configuration simplifies the subsequent assembly, disassembly or service of the overall nozzle in the field. In an exemplary embodiment, the subassembly includes a unitary core holder having a plate portion and an annular wall portion, with a discharge orifice disposed centrally in the plate portion. Additionally, the subassembly includes a disc-shaped core having a plurality of sloped passages. The core and core holder are cooperatively shaped to define generally cylindrical a whirl chamber in a space between a downstream surface of the core and the plate portion of the core holder. For fixing the core and core holder together, the core holder includes a lip which projects around the annular wall, the lip being deformed by a peening operation to extend partially over an upstream surface of the core. The integral, preassembled core subassembly is mounted to the discharge end of the nozzle body. When fluid is delivered to the nozzle, the fluid passes through the nozzle body, the sloped passages, whirl chamber, and discharges from the orifice in a hollow cone pattern.

18 Claims, 2 Drawing Sheets

SPRAY NOZZLE ASSEMBLY

FIELD OF THE INVENTION

The present invention relates generally to spray nozzles, and more particularly, to spray nozzle assemblies useful in fire protection applications.

BACKGROUND OF THE INVENTION

Restaurants and other commercial establishments typically have fire protection systems which include overhead nozzles for directing a spray onto cooking appliances and the like in the event of a fire. Such spray nozzle assemblies are commonly configured to direct a full cone spray pattern. In some instances, it is desirable to concentrate the spray in selected areas, which most likely would be the source of the fire, such as over the burners of a stove. To achieve such a concentration, spray nozzles have been developed to provide a hollow cone spray pattern, which results in a circular spray application zone.

Conventional spray nozzle assemblies conventionally include a multiplicity of components which must be assembled and disassembled at the site of use. For example, the components must be assembled and/or disassembled during installation, servicing, or updating of the fire protection system. Such components typically include an annular core member for imparting swirling movement to liquid, a disk for defining a discharge orifice, a foil disk for sealing the end of the spray nozzle assembly prior to actuation of the system, and one or more annular retaining rings, sleeves or caps to secure the aforementioned parts together in a stacked and appropriately relationship. The foil disk is replaced after each use of the nozzle. During initial assembly of the spray nozzle assembly, as well as during servicing or replacement of the downstream foil disk, it is necessary to handle the multiplicity of components and to assemble them in predetermined relation. This is not only time consuming, but can result in parts being positioned upside down or in improperly arranged orientation.

OBJECTS AND SUMMARY OF THE INVENTION

It is an object of the present invention to provide an improved spray nozzle, such as for a fire protection system. A more particular object of the invention is to provide a spray nozzle assembly which lends itself to easier assembly, disassembly and service.

Another object is to provide a spray nozzle assembly as characterized above which have fewer parts for handling and which are less susceptible for improper orientation during assembly and disassembly.

A further object is to provide a spray nozzle assembly of the foregoing type which is operable for directing a hollow cone spray pattern so as to enable concentrated liquid to be sprayed over selected areas, such as the multiplicity of burners on the stove.

In order to achieve these objects, the present invention provides a nozzle including an elongated body having opposite mounting and discharge ends and a an integral core subassembly which is mounted to the discharge end. The integral core subassembly has a unitary core holder and a flow guide member referred to herein as a core. The unitary core holder includes a plate portion and an annular wall extending from a periphery of the plate portion. A discharge orifice is disposed through a center of the plate portion. The core is a generally disk-shaped, having a opposite upstream and downstream sides and a peripheral edge. Additionally, the core includes at least one sloped passage in communication between the upstream side and the downstream side.

The core is mounted within an inner side of the annular wall, so that the core is spaced from the plate portion of the core holder to define a swirl chamber. The core subassembly can then easily be mounted with a nozzle body or removed for service.

So that the core and core holder are securely mounted together, in an embodiment, the core and core holder are shaped to cooperatively fit together. Additionally, a deformable lip of the annular wall of the core holder is "peened" or deformed over a portion of the core, thereby securely mounting the core and core holder together.

An advantage of the present invention is that it provides an improved nozzle assembly which is easier to assemble, disassemble, and service.

Another advantage of the present invention is that it provides a nozzle having a core subassembly which is assembled or disassembled from the other nozzle components as an integral component.

A further advantage of the present invention is that it provides an improved nozzle structure for generating a hollow cone spray pattern.

Additional features and advantages of the present invention are described in, and will be apparent from, the following description, drawings, and claims.

DETAILED DESCRIPTION OF THE DRAWINGS

Figure 1:
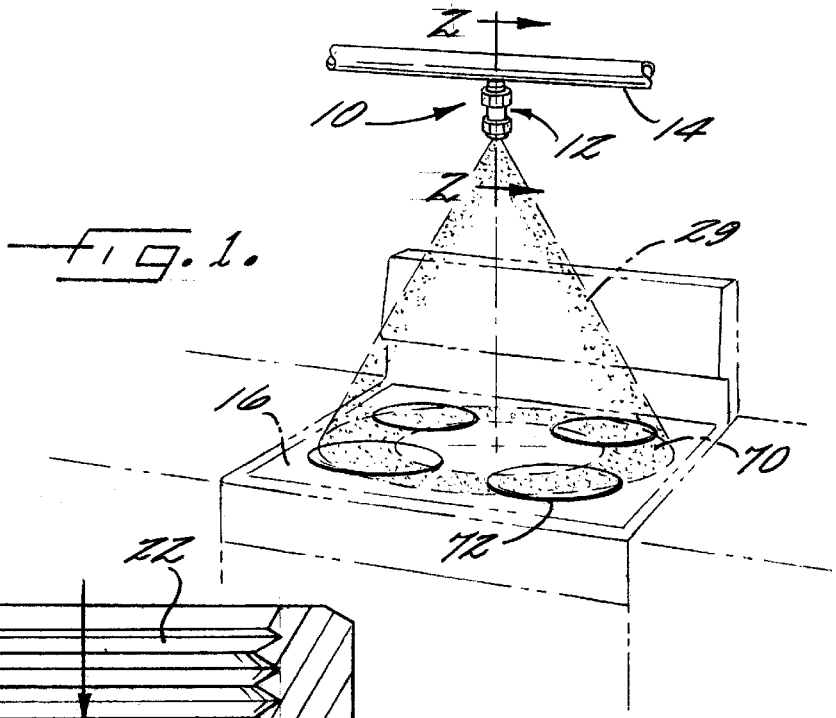
FIG. 1 is a fragmentary perspective view of a portion of a fire protection system showing a spray nozzle embodying the present invention, the nozzle shown spraying fluid downwardly in a hollow cone pattern onto an exemplary stove cook top below.

Referring now more particularly to the drawings, there is shown in FIG. 1 a fire protection system 10 including at least one spray nozzle 12 in accordance with the invention. In particular, in the illustrated fire protection system 10, the spray nozzle 12 is mounted on a liquid supply pipe 14 in overhead relation to a four burner cook top 16, such as in a commercial restaurant. It will be understood that the fire protection system may include a plurality of such nozzles connected to a common liquid supply.

Figure 2:
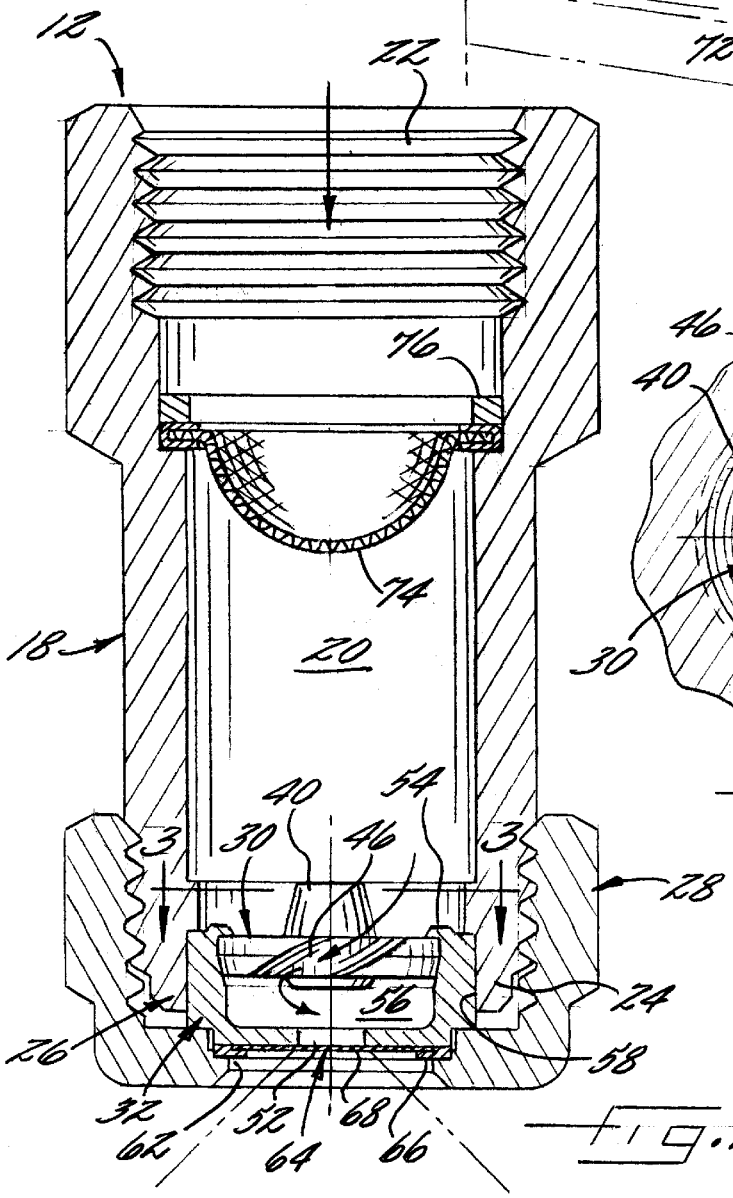
FIG. 2 is an enlarged vertical sectional view through the exemplary spray nozzle as taken generally along line 2—2 of FIG. 1.

As shown in FIG. 2, the illustrated spray nozzle 12 includes an elongated nozzle body 18 which is generally cylindrical in shape, defining an interior passage 20. The body 18 includes mounting end 22 with a threaded configuration for mounting onto a fitting of the liquid supply pipe 14. As illustrated, the mounting end has a female threaded configuration, however it will be understood that the mounting end could have a male threaded configuration instead. The nozzle 12 additionally includes a discharge end 24 opposite of the mounting end 22, and a core subassembly 26 mounted at the discharge end 24 of the body 18. Also, the nozzle 12 includes a retaining cap 28 for releasably securing the core subassembly 26 in mounted relation to the nozzle body 18.

According to the invention, the core subassembly has a simple and sturdy construction which allows the subassembly to be handled as an integral pre-assembled component, thereby simplifying the subsequent assembly, disassembly and service of the nozzle. Additionally, the core subassembly is itself simple in design. For example, in an embodiment, the subassembly includes merely a core and a unitary core holder which are secured together with an interference fit by a peening operation.

According to an aspect of the invention, the subassembly 26 is an integral component (FIG. 7) which, when mounted to the body 18 (FIG. 2), discharges fluid from the passage 20 in a controlled spray pattern 29, such as the hollow cone profile depicted in FIG. 1. The integral nature of the core subassembly 26 promotes ease of assembly with the body 18, reducing errors in assembly that could result in an improper discharge.

Figure 4:
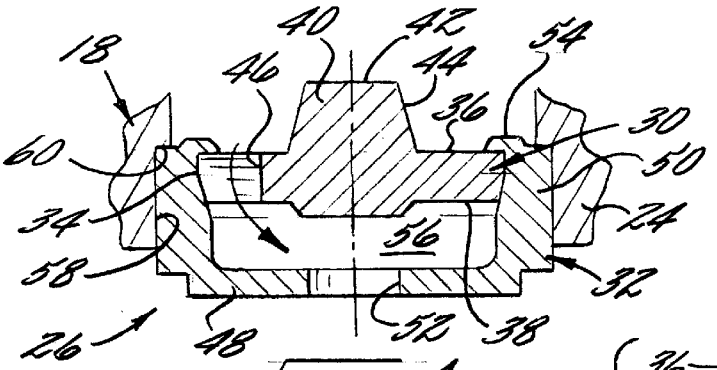
FIG. 4 is a vertical sectional view through the exemplary spray nozzle as taken generally along line 4—4 of FIG. 3.
Figure 5:
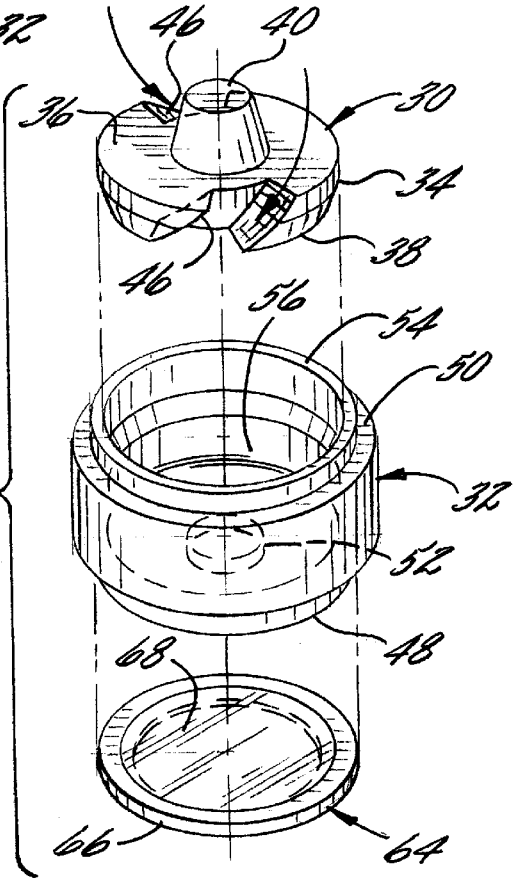
FIG. 5 is an exploded perspective view of a core assembly of the exemplary spray nozzle.
Figure 6:
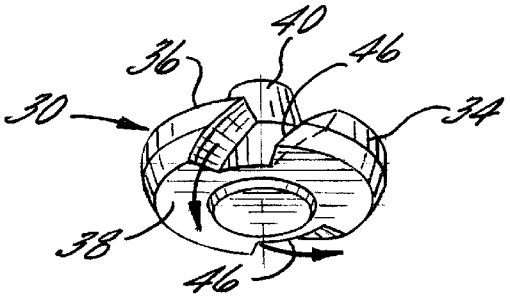
FIG. 6 is a perspective view of a flow guide of the exemplary nozzle.
Figure 7:
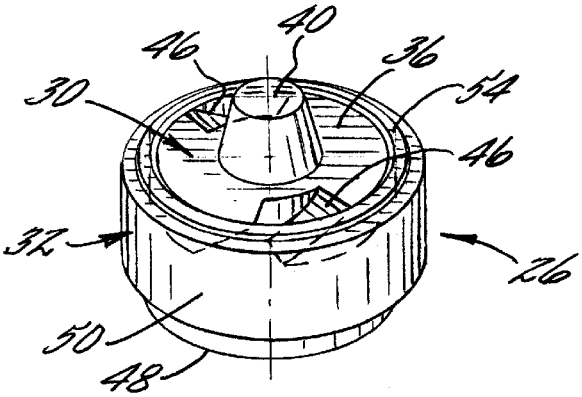
FIG. 7 is a perspective view of the core assembly.

Turning to FIGS. 4, 5 and 7, it is shown that the core subassembly 26 generally includes a core 30 and a unitary core holder 32. The core 30, shown isolated in FIG. 6, is generally disk shaped, having a peripheral edge 34, an upstream surface 36 and a downstream surface 38. In an embodiment, the core 30 further includes a central post 40 extending from the upstream surface 36 thereof As indicated in FIG. 4, the upstream post 40 has a flat upper end 42 and a conical side wall 44 to facilitate breaking up and separating the liquid flow stream in a downstream direction.

To guide the flow of fluid in a desired circular motion, the core 30 includes at least one sloped passage 46 to permit the passage of fluid between the upstream surface 36 of the core 30 and the downstream surface 38. In the illustrated embodiment, the core 30 includes two symmetrical sloped passages 46, located about 180 degrees from each other. Each of the sloped passages 46 has a generally sloped or angled shape to influence flow of the fluid in a predetermined rotational direction, as indicated by the flow arrows of FIGS. 2–6.

As also illustrated in FIGS. 4, 5 and 7, the core holder 32 is a unitary, cup shaped member. More specifically, the core holder 32 includes a plate portion 48 and an annular wall portion 50 extending in an axial direction from a periphery of the plate portion 48. To permit the exiting of fluid from the nozzle 12, a discharge orifice 52 is disposed centrally in the plate portion 48.

So that the core 30 and core holder 32 fit together, an inner side of the annular wall is shaped to cooperatively receive the peripheral edge 34 of the core 30. As shown in FIG. 4, the peripheral edge 34 of the core has an outwardly tapered or curved shape to snugly fit against the inner surface of the wall portion 50, which is inwardly tapered or curved in a complementary manner. Also, the core holder 32 includes an annular lip 54 which defines an opening to the core holder. In an initial condition prior to pre-assembly, as illustrated in FIG. 5, the lip 54 initially projects upright in an axial direction, and the shape of the lip 54 does not interfere with the opening, thereby permitting clearance for insertion of the core 30.

To permanently fix the core 30 and core holder 32 together, when the core 30 is received by the core holder 32 in a fitted position as illustrated in FIG. 4, the lip 54 is then deformed by a peening operation to extend over a portion of the upstream surface 36 of the core 30 adjacent the peripheral edge 34. The peened lip 54 secures the core 30 and core holder 32 together as an integral unit. The complimentarily tapered shape of the peripheral edge 34 of the core 30 and the annular wall portion 50 of the core holder 32 advantageously results in a tighter fit when the core 30 is pressed axially by the lip 54.

Figure 3:
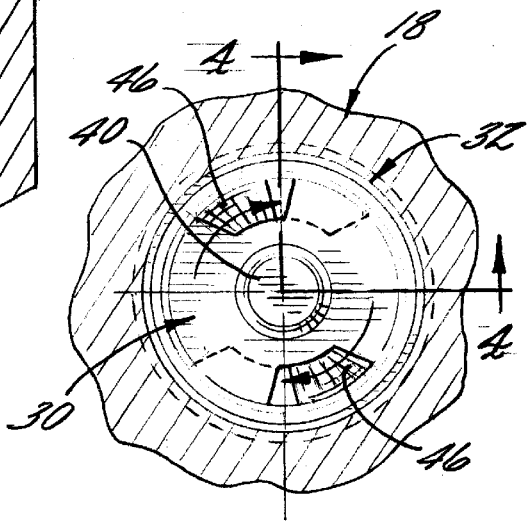
FIG. 3 is a an enlarged horizontal sectional view through the exemplary spray nozzle as taken generally along line 3—3 of FIG. 2

In order to cause a desired spray pattern, the pre-assembled core subassembly 26 includes an interior whirl chamber 56. More particularly, the core 30 is held in an axially spaced relation from the plate portion 48 of the core holder 32 so that the whirl chamber 56 is defined between the downstream surface 38 of the core 30 and an upstream surface of the plate portion 48. The whirl chamber 56 is generally cylindrical, being bounded by the inner side of the annular wall portion 50. As fluid enters the whirl chamber 56 through the sloped passages 46, the fluid is moves with a rotational motion, as indicated by the flow arrows of FIGS. 2–6, thereby causing a whirling motion within the whirl chamber 56, as illustrated in FIG. 3, and discharging from the orifice 52 in a hollow cone spray pattern 29, as shown in FIG. 1. It will be understood that the particular shape, depth and size characteristics of the whirl chamber 56 and orifice 52 dictates the characteristics of the hollow cone spray pattern 29, as shown in FIG. 1. It will be further understood that the angle of discharge may be predetermined by the selected design.

It will be appreciated by one skilled in the art that the core subassembly 26 can be factory pre-assembled in permanently fixed relation, for easy handling, installation, nozzle service, and replacement in the field. Turning to FIGS. 2 and 4, to facilitate subsequent accurate mounting of the core subassembly 26 in the nozzle body 18, the nozzle body 18 is formed with a counterbore 58 shaped to receive the subassembly 26. The counterbore 58 defines a shoulder 60, such that, in a fully inserted position, the shoulder 58 abuts against an upstream end of the core subassembly 26, as illustrated in FIG. 4. The downstream end of the core subassembly 26 complementarily meets with an annular step of the retention cap 28, as shown in FIG. 2. The retention cap 28 has a central opening 62 so that the orifice 52 is accessible.

A foil disk member 64 of a conventional type is mounted in interposed relation between the downstream end of the plate portion 48 of the core holder 32 and an annular edge of the retaining cap 28, as shown in FIG. 2. In the illustrated embodiment, the foil disk member 64 includes an outer ring 66 and a thin foil layer 68 bonded to and extending across the ring 66. The outer ring 66 may be constructed of copper, and the foil layer 68 may be constructed of aluminum. Prior to a use of the fire protection system, the foil layer 68 extends across the opening of the retainer cap 28, protectively covering the orifice 52. Accordingly, the foil layer 68 serves to protect the core subassembly 26 from contaminants the surrounding environment. For example, in a kitchen environment, the foil layer 68 prevents bugs, splattered food, airborne grease, etc. from entering the orifice 52. Upon actuation of the fire protection system, such as by means of a temperature sensor, pressurized liquid directed through the nozzle 12 will break the foil layer 68 and allow the discharge to emit from the orifice 52 in an unencumbered fashion.

To prevent the passage of particles or foreign matter, the nozzle 12 may include an optional strainer 74, as illustrated in FIG. 2. The strainer 74, as is generally known, is constructed of a wire mesh with a reinforcing outer ring. The strainer 74 resides against a ledge within the mounting end 22 upstream of the core subassembly 26. A retaining ring 76 fits adjacently above the strainer 74 and biased outwardly against the mounting end 22 to hold the strainer 74 securely in place.

It will be appreciated by one skilled in the art that since the nozzle 12 directs a hollow cone spray pattern 29, the nozzle 12 may be mounted above a stove, such as a four burner cook top stove 16 as illustrated in FIG. 1, such that upon actuation of the fire protection system, the hollow cone spray pattern 29 will direct concentrated amounts of liquid in an a ring shaped area 70 coinciding with the arrangement of the cooking burners 72, for maximum application of the extinguishing liquid at such locations.

While the invention is susceptible of various modifications and alternative constructions, certain illustrated embodiments thereof have been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

What is claimed is:

1. A spray nozzle for a fire protection system adapted to discharge a spray pattern generally shaped as a hollow cone, the nozzle comprising:

a hollow, elongated body having a mounting end adapted for connection to a fire extinguishing fluid line and a discharge end opposite the mounting end; and an integral core subassembly which is mounted to the discharge end, the core subassembly including:

a unitary core holder having a plate portion and an annular wall portion extending from a periphery of the plate portion, a discharge orifice disposed in the plate portion;

a generally disk shaped core having an upstream surface, a downstream surface opposite the upstream surface and a circular, peripheral edge, at least one sloped passage disposed in the core to permit fluid communication between the upstream side and the downstream side;

wherein core is mounted to the annular wall, the downstream surface of the core facing and being spaced from the plate portion of the core holder to define a cylindrical whirl chamber, and wherein the core subassembly is mounted to the discharge end of the elongated body.

2. The invention of claim 1, wherein each of the sloped passages is angled so that fluid which flows through the channel is directed into the whirl chamber with a rotating action.

3. The invention of claim 2, wherein the core includes two sloped passages disposed generally 180 degrees opposite each other and oriented to direct flow in a common rotational direction.

4. The invention of claim 1, wherein the nozzle assembly further comprises a foil disk mounted relative to the body downstream of the subassembly, the foil disk sealably covering the orifice.

5. The invention of claim 1, wherein the discharge end of the elongated body includes a counterbore sized to receive at least a portion of the core subassembly.

6. The invention of claim 5, the nozzle further comprising a retainer cap threadably engageable to the elongated body to secure the subassembly interposed between the retainer cap and the elongated body, the cap including an opening for providing access to the orifice.

7. The invention of claim 6, the nozzle further comprising a foil disk member mounted against a downstream side of the plate portion of the subassembly, the cap securing against the foil disk so that the foil disk covers the opening of the cap.

8. The invention of claim 1, wherein the peripheral edge of the core has an outwardly tapered shape to complementarily fit against the inner surface of the annular wall portion which has an inwardly tapered shape.

9. The invention of claim 8, wherein the core holder includes a lip projecting from an the annular wall portion around opening of the core holder, the lip being deformable over a portion of the upstream surface of the core to secure the core and core holder together.

10. The invention of claim 1, wherein the core includes a central conical post located on the upstream surface.

11. A core subassembly for a spray nozzle of a fire protection system, the core subassembly being mountable with a nozzle body having a passage to deliver extinguishing fluid, the subassembly discharging fluid from the passage in a controlled spray pattern, the core subassembly comprising:

a unitary core holder having a plate portion and an annular wall portion extending from a periphery of the plate portion, a discharge orifice disposed centrally in the plate portion; and a core having an upstream surface, a downstream surface opposite the upstream surface and a circular, peripheral edge, at least one sloped passage disposed in the core in providing fluid communication between the upstream side and the downstream side;

wherein core is mounted to an inner side of the annular wall, the core being spaced from the plate portion of the core holder to define a whirl chamber, and wherein the core subassembly is mounted to the discharge end of the elongated body.

12. The core subassembly of claim 11, wherein the peripheral edge of the core has an outwardly tapered shape to complementarily fit against the inner surface of the annular wall portion which has an inwardly tapered shape.

13. The core subassembly of claim 12, wherein the core holder includes a lip projecting axially from an the annular wall portion around opening of the core holder, the lip being deformable over a portion of the upstream surface of the core to secure the core and core holder together.

14. The core subassembly of claim 11, wherein each of the sloped passages is angled to cause fluid flowing through the channel to be directed into the whirl chamber with a rotating action.

15. The core subassembly according to claim 11, wherein the subassembly is operable to discharge fluid in a hollow cone spray pattern.

16. The core subassembly according to claim 11, wherein the core holder is generally cup-shaped.

17. A method of assembling a spray nozzle for a fire protection system, the method comprising:

providing a unitary core holder having plate portion and an annular wall portion extending from a periphery of the plate portion, a discharge orifice disposed centrally in the plate portion, the annular wall having an axially projecting lip defining an opening to the core holder;

providing a generally disk shaped core having an upstream surface, a downstream surface opposite the upstream surface and a circular, peripheral edge, at least one sloped passage disposed in the core in providing fluid communication between the upstream side and the downstream side;

inserting the core within the annular wall portion, so that the downstream surface of the core faces the plate portion and is supported in a spaced relation therefrom to define a whirl chamber;

peening the lip so that the lip deforms to extend over a portion of the upstream surface of the core.

18. The method of claim 17, wherein the peripheral edge of the core has an outwardly tapered shape and the annular wall portion has an inwardly tapered shape, the method further comprising the step of seating the peripheral edge against the annular wall portion.

* * * * *